US005119713A

United States Patent [19]

Usa et al.

[11] Patent Number: 5,119,713

[45] Date of Patent: Jun. 9, 1992

[54] ELECTRONIC MUSICAL INSTRUMENT HAVING A PORTAMENTO FUNCTION UTILIZING WHOLE AND HALF TRANSFORMATIONS

[75] Inventors: Satoshi Usa; Eiichiro Aoki, both of Hamamatsu, Japan

[73] Assignee: Yamaha Corporation, Hamamatsu, Japan

[21] Appl. No.: 529,103

[22] Filed: May 25, 1990

[30] Foreign Application Priority Data

May 26, 1989 [JP] Japan ..... 1-133256

[51] Int. Cl.[5] ..... G10H 1/02; G10H 7/00

[52] U.S. Cl. ..... 84/628; 84/704

[58] Field of Search ..... 84/628, 662, 704, 737

[56] References Cited

U.S. PATENT DOCUMENTS 4,892,023 1/1990 Takeuchi et al. ..... 84/704 X

FOREIGN PATENT DOCUMENTS 16-11968 6/1941 Japan .

*Primary Examiner*—Stanley J. Witkowski

*Attorney, Agent, or Firm*—Spensley Horn Jubas & Lubitz

[57] ABSTRACT

A keyboard and a portamento bar are connected to a tone generator through a common channel assigner to use each tone generating channel either for generating a keyboard sound or for generating a portamento sound. Thus, a portamento sound can be generated without a need for providing a another tone generator. Further, such arrangement is provided that can shift the tone generation from a keyboard sound to a portamento sound and from a portamento sound to a keyboard sound, enabling initiation and termination of a portamento performance to have accurate pitches.

10 Claims, 9 Drawing Sheets

REGISTERS

| | |
|---|---|
| KCD | KEY CODE DATA FOR KEYBOARD (UPPER BITS ONLY, LOWER BITS ALL ZERO) |
| PKCD | KEY CODE DATA FOR PORTAMENTO |
| PKCDH | UPPER BITS |
| PKCDL | LOWER BITS |
| PON | PORTAMENTO ON (DEPRESSION EXISTS) |
| POS | PORTAMENTO DEPRESSION POSITION |
| C | PORTAMENTO COEFFICIENT |
| FN | F NUMBER |
| ASCH | ASSIGN CHANNEL |

TONE GENERATING CHANNEL INFO. REGISTERS

| | |
|---|---|
| KTG(0) | TGKCD(0)UPPER BITS |
| PTG(0) | TGKCD(0)LOWER BITS |
| KTG(1) | TGKCD(1)UPPER BITS |
| PTG(1) | TGKCD(1)LOWER BITS |
| KTG(2) | TGKCD(2)UPPER BITS |
| PTG(2) | TGKCD(2)LOWER BITS |
| ⋮ | ⋮ |
| KTG(n-1) | TGKCD(n-1)UPPER BITS |
| PTG(n-1) | TGKCD(n-1)LOWER BITS |

Fig. 1B

MAIN-ROUTINE

KEY-ON EVENT

KEY-OFF EVENT

PORTAMENTO PROCESSING

SUB-ROUTINE X

PORTAMENTO-ON PROCESSING

PORTAMENTO-OFF PROCESSING

ELECTRONIC MUSICAL INSTRUMENT HAVING A PORTAMENTO FUNCTION UTILIZING WHOLE AND HALF TRANSFORMATIONS

BACKGROUND OF THE INVENTION

1. Field of the Invention

This invention relates to an electronic musical instrument, and more particularly to an electronic musical instrument provided with portamento function.

In this specification, "portamento" means continuous or gradual change in the pitch of generated musical sound, and includes slur.

2. Description of the Related Art

In performance of a musical instrument, portamento play may sometimes be desired, in which the pitch of the musical sound continuously changes from one pitch to another pitch.

In an electronic musical instrument of the keyboard type, a portamento bar for assigning a continuously changing pitch sound may be provided besides a keyboard which is used for generating scale sounds. By manipulating the portamento bar, a portamento sound which changes the pitch continuously can be generated, in addition to the ordinary performance in the keyboard for generating scale sounds.

For example, Japanese Utility Model Publication No. Sho. 41-11968 discloses an example of a portamento system which can be applied to a keyboard instrument such as an organ. FIG. 9 reproduces this structure. A portamento system 61 having an oscillator system installed therein is detachably attached to a host instrument 65 in front of a keyboard 60. A sliding terminal 64 for achieving portamento performance may be slid over a resistance element 63 which constitutes an oscillation circuitry to continuously change the resistance and hence to continuously change the oscillation frequency of the oscillator. Thus, a portamento sound having a continuously changing pitch can be generated from the oscillator, in response to the movement of the sliding terminal 64. In this way, by adding a portamento system to an ordinary keyboard instrument, it is made possible to achieve such a performance in which while the left hand plays the keyboard to generate a chord sound, the right handplays the sliding terminal of the portamento system to generate the melody in a portamento sound.

SUMMARY OF THE INVENTION

An object of this invention is to provide an electronic musical instrument in which a keyboard and a portamento means have a close relationship and tone generator circuits for generating scale sounds and portamento sounds are at least partially in common.

Another object of this invention is to provide an electronic musical instrument having a keyboard and a portamento system, capable of generating a portamento sound of accurate pitch.

According to an aspect of this invention, there is provided an electronic musical instrument comprising: a keyboard having a plurality of keys capable of designating respective predetermined scale pitches; a portamento bar capable of designating a substantially arbitrary pitch; first detection means for detecting manipulation information of said keyboard; second detection means for detecting manipulation information of said portamento bar; a tone generator having a plurality of tone generating channels, each being commonly connected to the manipulation information of said keyboard and said portamento bar; and tone generation assignment means for assigning generation of musical sound to said tone generating channels based on the manipulation information of said keyboard and said portamento bar.

BRIEF DESCRIPTION OF THE DRAWINGS

FIG. 1A and 1B schematically illustrate an electronic musical instrument provided with portamento function, wherein FIG. 1A is a block diagram of the total system, and FIG. 1B is a schematic diagram showing an example of a group of registers.

DESCRIPTION OF THE PREFERRED EMBODIMENTS

Embodiments of this invention will be described hereinbelow referring to the accompanying drawings.

Figure 1A:
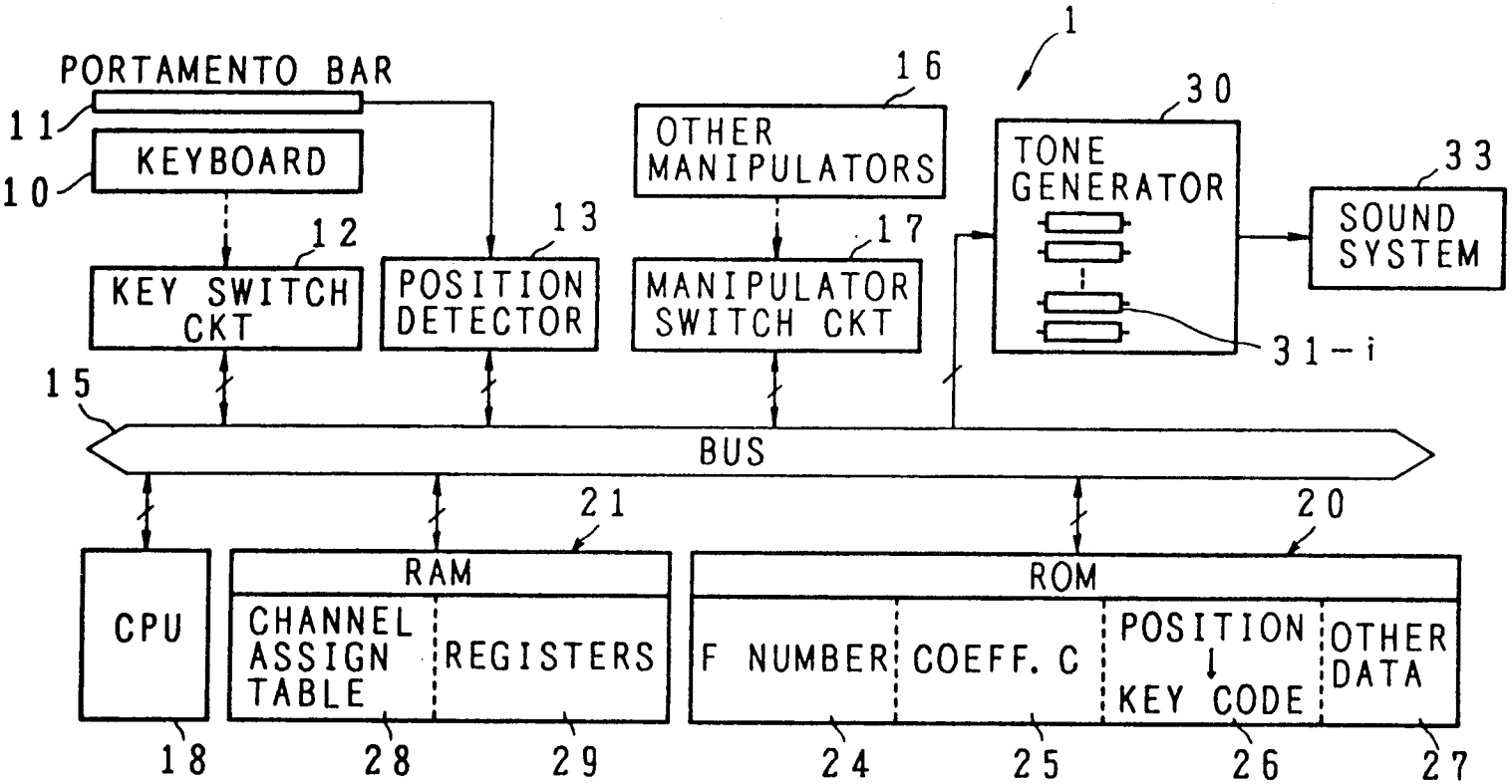

FIG. 1A is a block diagram of an electronic musical instrument provided with portamento function. Performance of the instrument may be achieved either in a keyboard 10 or in a portamento bar 11. There are also provided other manipulators 16. Performance in the keyboard 10 is detected in a key switch circuit 12. Information signals representing the key manipulation are sent to a bus 15. Performance in the portamento bar 11 is detected in a position detecting circuit 13. Information signals representing the manipulation position in the portamento bar is sent to the bus 15. Here, it is also possible to include touch information in the manipulation information. Other manipulators 16 are provided, for example, for setting tone color, sound volume, etc. for the depressed key sound or the portamento sound. Manipulations of other manipulators 16 are detected in a manipulator switch circuit 17, to send information signals representing those manipulations also to the bus 15. These information signals sent to the bus 15 are processed under the control of a CPU 18, and sent to a tone generator 30 having a plurality of tone generating channels 31-i. Tone signals generated from the respective tone generating channels 31-i of the tone generator 30 are sounded as musical sounds through a sound system 33. The tone generator 30 and the sound system are commonly used for the keyboard 10 and the portamento bar 11.

In processes for generating tone signals, a ROM 20 and a RAM 21 both connected to the bus 15 are used. The ROM 20 has an F number table 24 storing F numbers representing the scale tone pitch frequencies of the respective keys in the keyboard 10, a transformer 26 formed of a table or a processor for transforming information representing the manipulation position in the portamento bar supplied from the position detecting circuit 13 into a key code having higher bits and lower bits, a coefficient data table 25 for the transforming the lower bits of the key code into a coefficient C representing an intermediate pitch between two adjacent scale pitches, and memories 27 for storing various data including control program for the CPU.

Here, the portamento bar 11 is disposed spatially parallel to the keyboard 13, for example in front of or at the back of the keyboard 13. Correspondence between the pitch of the keyboard and the pitch of the portamento bar is taken, so that the same positions on the keyboard and on the portamento bar produce the same pitch. Here, since the pitch gap between the adjacent keys may either a half tone or a whole tone, two kinds of gradients should mixedly exist in the relation between the position and the pitch of the portamento bar. The transformer 26 carries out such transformations.

The RAM 21 includes a table 28 for processing channel assignments, and other registers 29, etc.

FIG. 1B illustrates an example of a group of various registers contained in the RAM 21. In the figure, the registers shown at the lefthand side include KCD registers, each for storing key code KCD for a depressed key in the keyboard which has only upper significant bits, with lower bits set all zero, a PKCD register for storing a portmento key code PKCD which has both upper bits PKCDH and lower bits PKCDL, a PON register for storing a portamento-on flag PON representing that the portamento bar 11 is being depressed, a POS register for storing a depressed position POS in the portamento bar 11, a C register for storing coefficient C designating an intermediate pitch of the portamento sound, FN registers each for storing an F number FN corresponding to a depressed key, ASCH registers each for storing an assigned channel number ASCH, indicating that the tone generating channel of interest is designated for tone generation, etc.

The keyboard key code KCD is, for example, a 7-bits data, in accordance with the number of keys, since it is used to designate the respective key tone in the keyboard 10. The portamento key code PKCD should be able to designate an intermediate pitch between adjacent keys as a portamento sound, as well as a scale sound. For example, the portamento key code PKCD is a 14-bits data which is formed of higher 7-bits PKCDH corresponding to the keyboard key code and lower 7-bits PKCDL denoting an intermediate pitch between adjacent keys. Here, for uniformalizing the bit numbers for the keyboard key code KCD and the portamento key code PKCD, the keyboard key code KCD is reformed into 14-bits data which is formed by adding lower 7-bits data of all "0" to the 7-bits key code data.

In the figure, the registers shown at the righthand side store information on the respective tone generating channels. It is assumed that the tone generator 30 has n tone generating channels, from 0- to (n−1)- tone generating channel. Each of the tone generating channels can selectively perform tone signal generation for the keyboard sound and the portamento sound. Based on such configuration, each channel has a keyboard sound flag KTG (representing that a keyboard sound is assigned) and a portamento sound flag PTG (representing that a portamento sound is assigned) which jointly designate that the channel is assigned for a keyboard sound or a portamento sound.

Although it will be obvious for those skilled in the art, the flags KTG and PTG can not simultaneously take "1" state for the same channel. When a musical sound is generated with respect to a certain (i-th) channel, KTG(i) is "1" or PTG(i) is "1", depending on the sound being generated is a keyboard sound or a portamento sound. The pitch of the musical sound being generated is represented by the key code in a register TGKCD(i). Here, a portamento key code PKCD or keyboard key code is written in the register TGKCD(i) depending on the channel assignment of a portamento sound or a keyboard sound. In case of a keyboard sound, the lower bits of TGKCD(i) are all "0".

Figure 2:
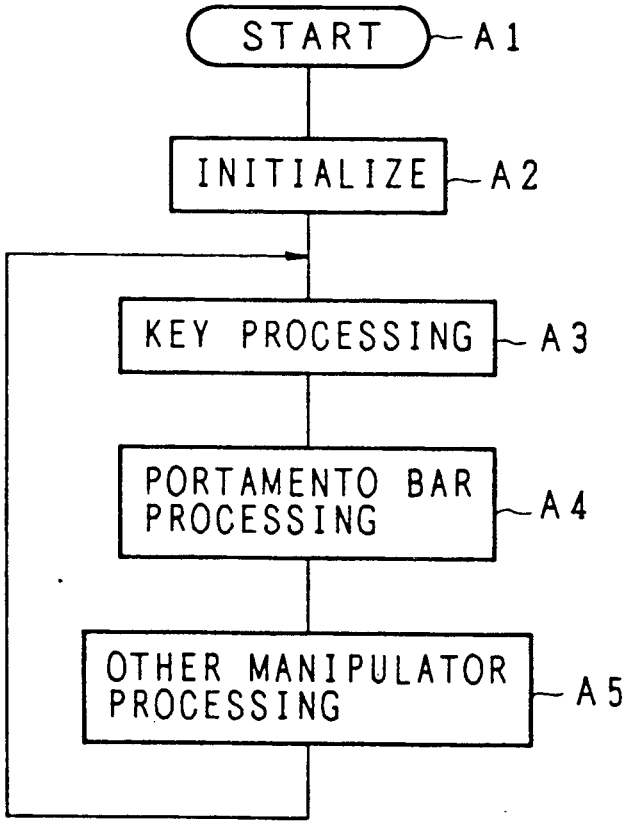
FIG. 2 is a flow chart of a main routine

FIG. 2 shows a flow chart of the main routine showing the operation of an electronic musical instrument provided with portamento function as shown in FIG. 1A.

In FIG. 2, after the start (step A1), initiation (step A2) is done for setting the initial conditions of various information in the registers in the RAM 21, etc..

After the initiating step, keyboard processing is done in the keyboard processing step (step A3), to detect a new key depression (key-on event) or a new key release (key-off event) in the keyboard 10, based on the output of the key switch circuit 12, which scans the keyboard, and when there is an event, to effect tone generation control processing for the keyboard sound corresponding to that event.

Next, processing of portamento bar (step A4) will be done. When a manipulation of the portamento bar 11 is detected based on the output of the position detecting circuit 13, tone generation processing for a portamento sound is achieved.

Following the portamento bar processing (step A4), processing for other manipulaters (step A5) will be done, to achieve processings corresponding to the manipulated states of other manipulaters based on the output of the manipulater switch circuit 17 (for example, setting of tone color, sound volume, etc.).

Musical sounds corresponding to the performance can be generated by repeating these processings for the keyboard, the portamento bar, and other manipulaters.

Hereinbelow, detailed description will be made on the keyboard processing step A3, the portamento bar processing step A4, and other manipulaters processing step A5.

First, processings in the keyboard processing step A3 when a key-on event or a key-off event is detected, will be described separately.

Figure 3:
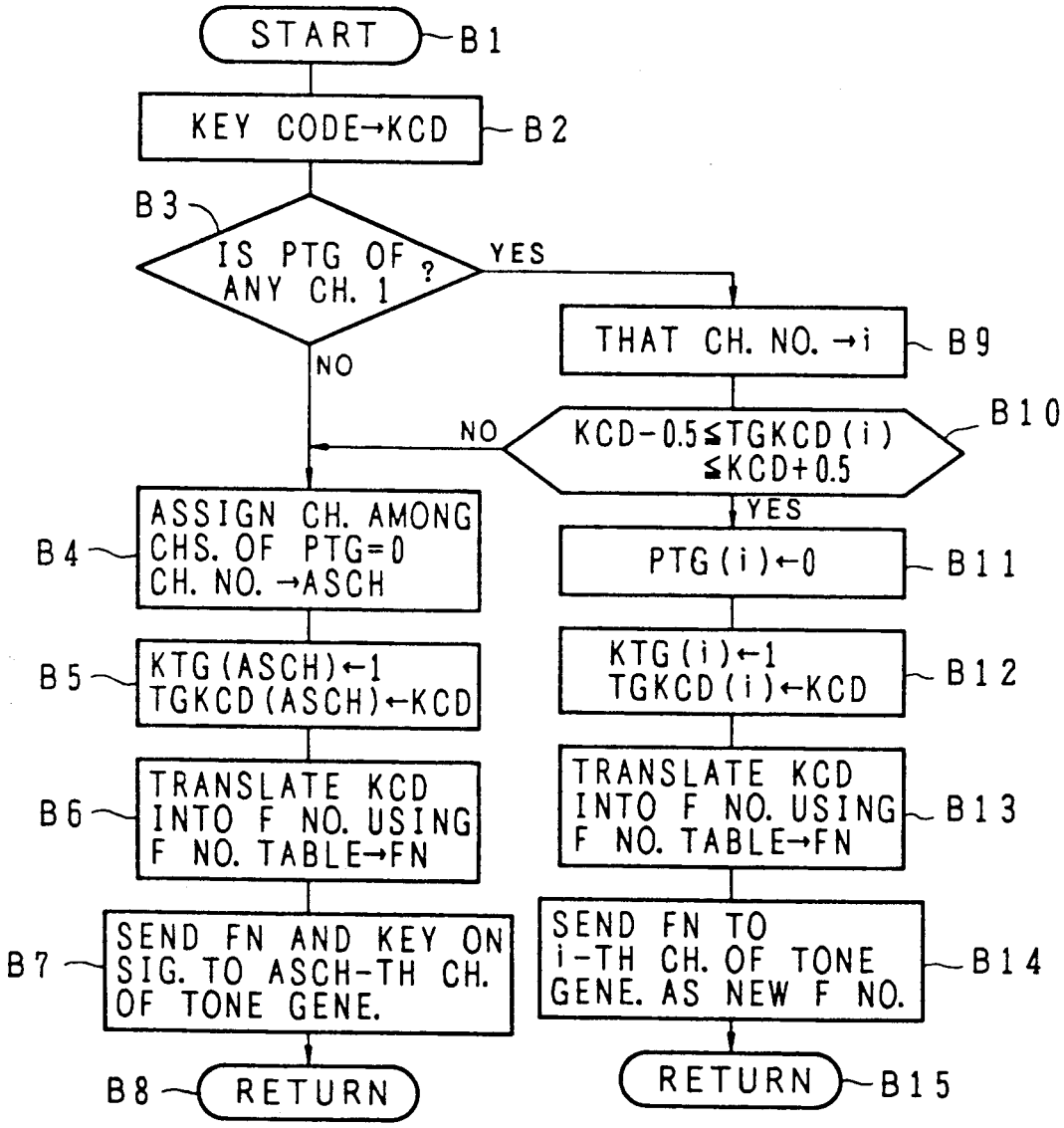
FIG. 3 is a flow chart of a key-on event.

FIG. 3 is a flow chart of the key-on event processing. When a new key depression (key-on event) is detected, the key-on event processing is started in step B1. In this processing, first a keyboard key code KCD representing a key in which a key-on event has occurred is fetched in the KCD register (step B2).

Next, channel assignment for the keyboard key code KCD stored in the KCD register will be done. In this embodiment, a keyboard sound is generated with priority to a portamento sound. Especially, it is arranged that if the portamento sound which is being generated now has substantially the same pitch as the pitch of a newly depressed key, the newly depressed key sound will be assigned to the channel to which the portamento sound has been assigned. Therefore, it is first checked whether a portamento sound is assigned to any of the tone generating channels by searching a channel of PTG="1" throughout the channels (step B3). If PTG="0" in each of the channels, no portamento sound assignment is done. Then, the flow proceeds to step B4 along the arrow of "NO".

In the step B4, a channel to which the key code KCD of a newly depressed keyboard sound stored in the KCD register will be assigned is decided by searching one channel among the channels of PTG="0". The decided channel number is registered in the ASCH register as an assigned channel ASCH. When all the tone generating channels have been assigned, well-known truncate processing may be adopted in this decision of a new assigned channel ASCH. For example, the most oldly released channel, or the most decayed channel will be detected and assigned for a new tone.

Next, the flag KTG(ASCH) of the channel denoted by the assigned channel ASCH decided in the step B4 is set to "1" to register that this channel is a channel generating a keyboard sound. Further, the key code KCD of the newly depressed key stored in the KCD register is written into a register TGKCD (ASCH) for the channel assigned by the assign channel ASCH (step B5). The channel assignment for a newly depressed keyboard sound is achieved hereby.

Using the key code KCD stored in the channel-assigned tone generator key code register TGKCD(ASCH) and representing the pitch of the newly depressed key, an F number FN corresponding to the tone pitch frequency of the newly depressed key will be read out from the F number table 24 in the ROM 20 (step B6).

The F number FN thus obtained is sent to a tone generating channel in the tone generator 30 assigned by assign channel ASCH together with a key-on signal (step B7). By this action, generation of a tone signal having a pitch corresponding to the F number FN is initiated in the assigned channel ASCH.

Further, when a new key depression occurs, if a portamento sound has been assigned already to some tone generating channel, the PTG of that channel should have been changed to "1" and the discrimination of the step B3 should be YES. Then, the flow proceeds to step B9.

First, the number i of the channel to which the portamento sound was assigned (the channel having PTG="1") is sought (step B9).

Then, regarding the i-th channel, check is done whether the pitch indicated by the tone generator key code TGKCD (i) is located within a predetermined pitch range around the pitch of the new keyboard sound indicated by the key code KCD in the KCD register or not (step B10).

In this embodiment, check is done whether the pitch of the portamento sound TGKCD(i) is within the range of ±0.5 (corresponding to a half of the pitch gap between adjacent keys) on the higher pitch side or the lower pitch side of the newly depressed key tone. Here, the numerical range can be arbitrarily set. If the portamento sound is not in the predetermined neighborhood of the newly depressed key (i.e. when the discrimination of the step B10 is NO), the newly depressed key will be treated independently of the portamento sound, and processing proceeds from step B10 to step B4, to achieve the above-mentioned ordinary assignment processing.

If the pitch of the newly depressed keyboard sound is near the portamento sound (when the discrimination of the step B10 is YES), processing is done for shifting the tone generation of the channel from the portamento sound to the keyboard sound. That is, with respect to the i-th tone generating channel generating the portamento sound, PTG(i) representing the generation of a portamento sound is set to "0" (step B11), and KTG(i) is set to "1" to represent that the keyboard sound is generated. Further, the pitch of the newly depressed keyboard sound in the KCD register is sent to the register TGKCD(i) (step B12).

When the channel assignment for a newly depressed key is done in this way, the processing proceeds to steps B13 and B14, and F number FN corresponding to a newly depressed key (KCD) is read out from the F number table 24 and is sent to the i-th tone generating channel of the tone generator 30, similar to steps B6 and B7. In step B14 in this case, however, no key-on signal is being sent, being different from step B7. This is because the i-th channel of the tone generator 30 has already been generating a tone signal of a portamento sound. While the tone generating action is being maintained, only the pitch of the generated tone signal is changed to the pitch of a newly depressed key.

Tone generation for the newly depressed key is done in this way. Then, the key-on event processing is ended by returning the flow to the start (step B15).

What is important in steps B10, B11, and B12 is that when a portamento sound has been generated in the neighborhood of the pitch of a newly depressed key, the tone generation of the portamento sound will be shifted into the tone generation of the depressed key. In this case, the tone generating channel being used for generating the portamento sound will continuously be used for generating the tone of the newly depressed key in the keyboard.

Figure 4:
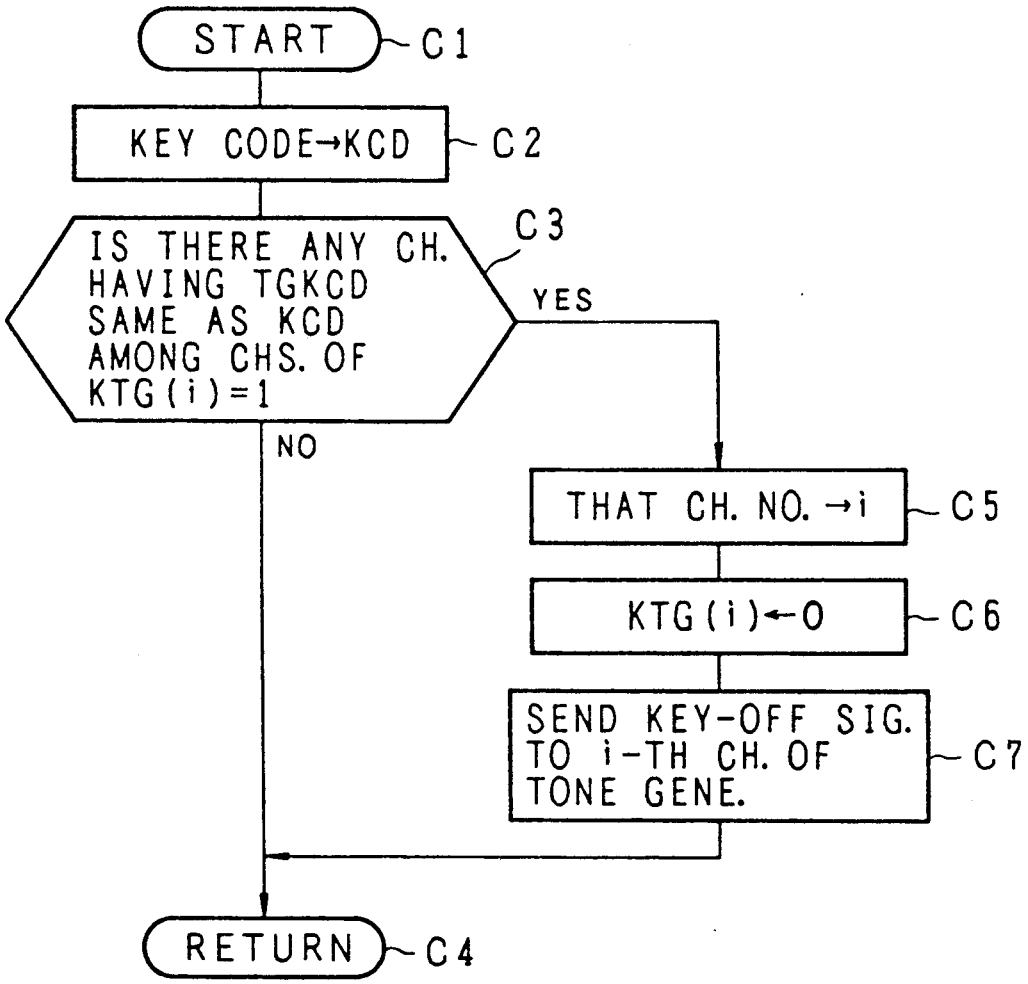
FIG. 4 is a flow chart of a key-off event.

FIG. 4 is a flow chart of the key-off event processing.

First, in step C1, the key-off event processing is started, when release of a key in the keyboard is detected. A key code KCD corresponding to the newly released key will be written into a KCD register (step C2).

Then, it is checked whether there is any channel having the same key code as the key code KCD obtained in step C2 among the channels of KTG(i)="1" in the tone generating channel information registers shown in FIG. 1B. Namely, comparison is done between KCD and upper bit of TGKCD of the respective tone generating channels of KTG(i)="1" (step C3).

If there is no channel having the same key code, the tone of the released key is not channel-assigned now. Then, the processing will return to the initial step (step C4). If there is a channel having the same key code, the number i of that channel is obtained (step C5).

The flag KTG(i) of this channel i is set to "0" (step C6). Namely, the channel assignment is released, and it is declared that the tone generation corresponding to this channel will be halted.

Then, a key-off signal is sent to the i-th tone generating channel of the tone generator 30 (step C7). By this action, a tone signal of release state after the key release is generated in the i-th tone generating channel of the tone generator 30, and the key-off processing is done. Thereafter, the operation returns to the initial state (step C4).

Figure 5:
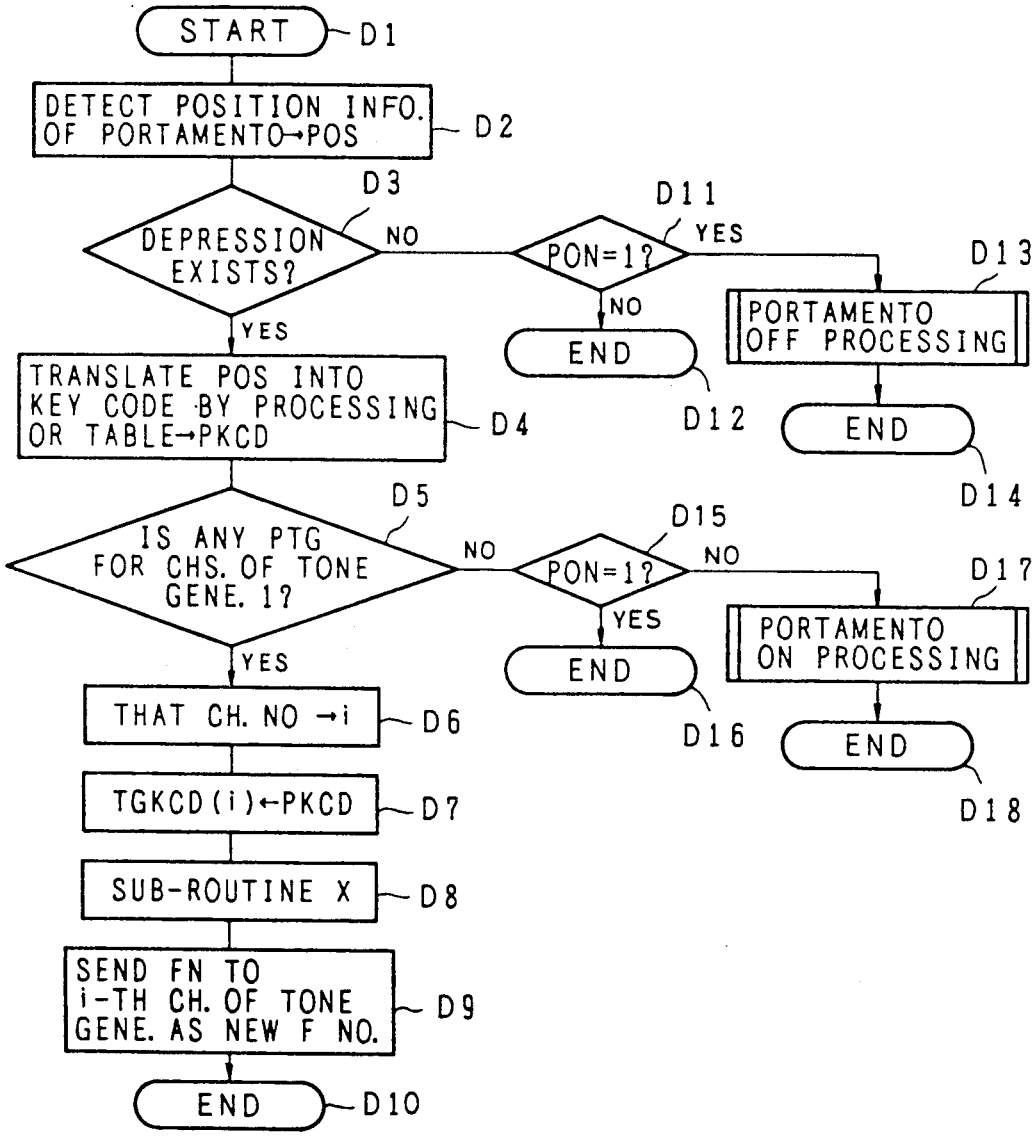
FIG. 5 is a flow chart of a portamento processing.

Next, description will be made on the processing of the portamento bar manipulation. FIG. 5 is a flow chart showing the portamento processing.

First, portamento processing is started (step D1). Then, the position information representing the depressed position in the portamento bar 11 is stored in the POS register (step D2). Next, it is checked whether a depressing operation is being done in the portamento bar 11 from the position information of the POS register (step D3). This step may be substituted by checking whether there is a pressure above a certain level in the portamento bar or not when the portamento bar is provided with a pressure detector. When there is a depression, the position information in the POS register is transformed into a portamento key code PKCD using the transformation table 26 or transformation formulae in the ROM 20 (step D4).

Figure 6:
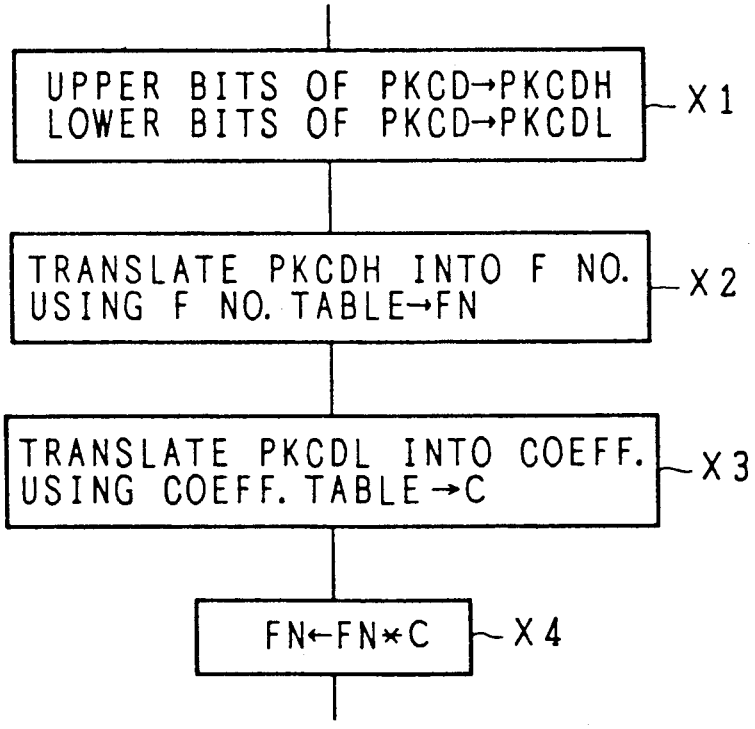
FIG. 6 is a flow chart of sub-routine X.

Next, detection whether the portamento sound generation has already been done in any of the tone generating channel of the tone generator 30 or not is done by searching a channel having a flag PTG="1" (step D5). Then, the channel number i of the channel performing the portamento sound generation is obtained (step D6). A new portamento key code PKCD corresponding to the depression position in the portamento bar 11 is inputted to the tone generator key code register TGKCD (i) of this i-th channel (step D7). By this operation, a new portamento sound pitch to be continuously generated is indicated. Thereafter, a sub-routine X is performed (step D8). This sub-routine X is shown in FIG. 6. Let the upper bits and the lower bits of the portamento key code PKCD be PKCDH and PKCDL (step X1).

Then, PKCDH is transformed into an F number FN using the F number table 24 in the ROM 20 (step X2).

Next, PKCDL is transformed into a coefficient data C using the coefficient table 25 of the ROM 20 (step X3). Here the coefficient table 25 stores the information corresponding to coefficients C changing exponentially as $1-2^{1/12}$ (corresponding to a half tone) in response to the value of 0000000-1111111 of the PKCDL.

By multipling this coefficient C to the F number FN, an F number FN corresponding to the value of PKCD is obtained (step X4). The newly obtained F number FN has lower bits, as well as higher bits, and can generate an intermediate pitch sound between adjacent keys.

Description will be continued referring to FIG. 5. The new F number FN obtained in the step X4 is sent to the i-th tone generating channel of the tone generator 30 which has been generating a portamento sound (step D9). Then, this operation is terminated (step D10). By this action, the pitch of the portamento sound is changed corresponding to the new depressed position in the portamento bar 11.

When the depression position in the portamento bar is changed continuously, the above operation is repeated to substantially continuously change the pitch.

When there is no depression in the portamento bar 11, it is checked whether the portamento-on data PON is "1" or not (step D11). If PON is not "1", the portamento bar 11 is not at all manipulated. Thus, a series of operations end here (step D12).

If, PON="1", it means that the portamento bar 11 was depressed to generate a portamento sound, and depression manipulation in the portamento bar 11 has now been released. Thus, for terminating the generation of the portamento sound, a portamento-off processing (step D13) is performed. Then, a series of operations is terminated (step D14).

When there is a depression in the portamento bar 11 and there exists no channel which generates a portamento sound (when the discrimination in the step D5 is NO), it is checked whether PON is "1" or not (step D15).

If PON is "1", the portamento-on processing as will be described later has already been performed for generating a portamento sound and the processing is ended (step D16). This corresponds to a state where the tone generating channel which has been assigned to generating a portamento sound is re-assigned to a newly depressed keyboard sound, thereby diminishing a portamento sound generating channel.

If PON is not "1", portamento-on processing has not been done, and hence portamento-on processing is newly achieved (step D17), and then a series of operation is ended (step D18).

Figure 7:
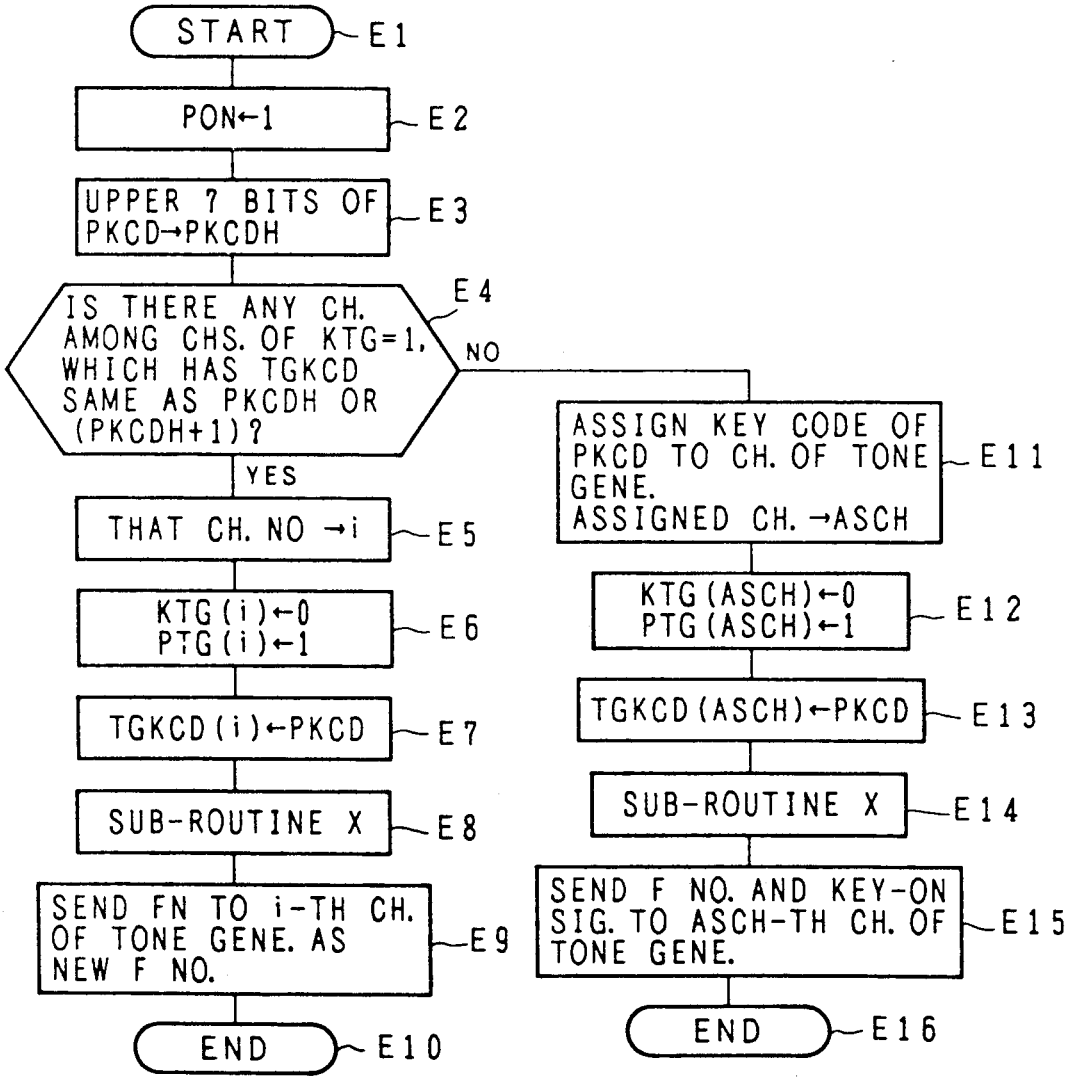
FIG. 7 is a flow chart of a portamento-on processing.

FIG. 7 is a flow chart of the portamento-on processing.

First, the processing is started (step E1), and the flag PON is set to "1" (step E2).

Next, the upper 7-bits of the portamento key code PKCD (those obtained in the step D4 of FIG. 5) corresponding to the depressed position in the portamento bar 11 is set in PKCDH (step E3).

Next, it is checked whether there is any channel which has a pitch in a predetermined neighborhood of the pitch corresponding to the depressed position in the portamento bar, among the channels which generate keyboard sounds (channels of KTG="1") based on the contents of PKCDH and TGKCD (step E4). In this embodiment it is checked whether the same scale pitch as PKCDH or one higher scale pitch exists in any channel or not. Namely, if the portamento sound designated by PKCDH is located between the n-th key and (n+1)-th key, it is checked whether this n-th key sound or (n+1)-th key sound is being generated or not.

If there is a depressed key sound which has a pitch in the neighborhood of the pitch of a portamento sound designated by the depression in the portamento bar 11, the number i of the channel to which the depressed key sound has been assigned is obtained (step E5). Then, regarding the i-th channel, the flag KTG(i) representing generation of a keyboard sound is set to "0" and another flag PTG(i) representing generation of a portamento sound is set to "1", to change over the sound generation from the keyboard sound to the portamento sound (step E6).

Next, the portamento key code PKCD is inputted to the TGKCD(i) register of this channel (step E7).

Thereafter, the aforementioned sub-routine X (FIG. 6) is achieved (step E8), to supply the obtained F number FN as a new F number of the i-th tone generating channel of the tone generator 30 (step E6). The processing is ended by this operation (step E10).

In case when the portamento sound corresponding to the depressed position in portamento bar 11 is departed from the pitch of any keyboard sound being generated (when the discrimination of step E4 is NO), the generation of the portamento sound will be treated as an independent tone generation command.

Namely, a channel is decided among the channels of the tone generator 30 and denoted as ASCH to which the portamento sound designated by a manipulation in the portamento bar 11 will be assigned (step E11).

Then, the KTG of the channel designated by the assigned channel ASCH is set to "0", and PTG of the channel is set to "1" (step E12). Further the portamento key code PKCD is inputted to the register TGKCD(ASCH) associated with the channel indicated by ASCH (step E13).

By these steps, the channel indicated by ASCH is assigned for generating the portamento sound.

Next, sub-routine X is performed (step E14), and the obtained F number FN and the key-on signal are sent to the tone generating channel (ASCH) of the tone generator 30 (step E15). Then, the processing is ended (step E16).

In the portamento processing as described above, it is to be noted that a keyboard sound may shift into a portamento sound. When there is a new depression in the portamento bar, it is searched for whether there is an already generated keyboard sound in the neighborhood of the indicated pitch. When there is a keyboard sound in the neighborhood of the portamento bar pitch, the keyboard sound is exchanged to the portamento sound (steps E4–E6).

Figure 8:
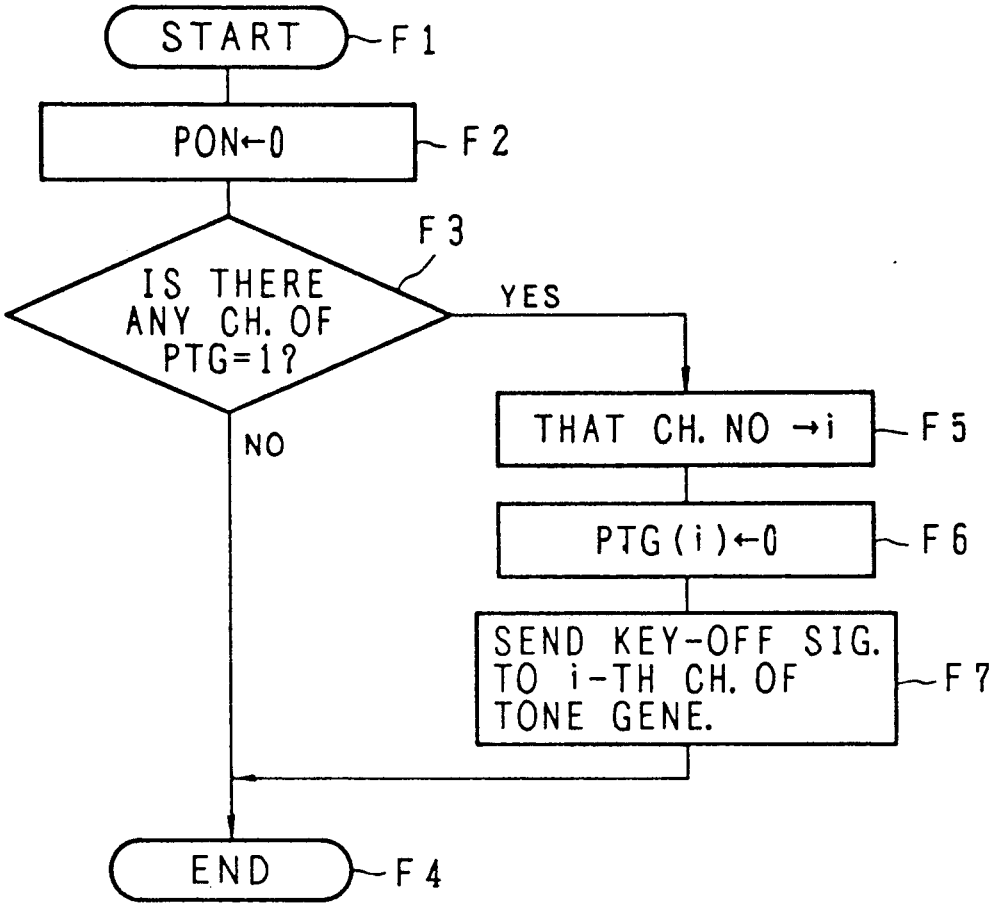
FIG. 8 is a flow chart of a portamento-off processing.
Figure 9:
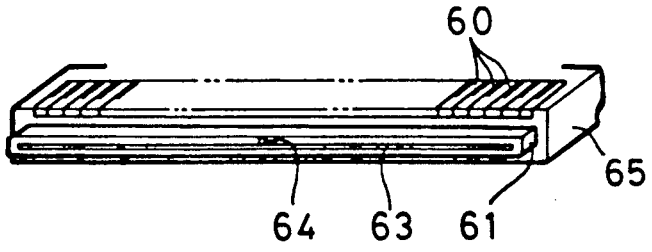
PRIOR ART Fig. 9
FIG. 9 is a perspective view of an electronic musical instrument provided with portamento function according to prior art.

FIG. 8 is a flow chart of the portamento-off processing.

First, the processing is started (step F1), and the flag PON is set to "0" to pronounce the termination of tone generation of the portamento sound (step F2). Next, channels having PTG="1" are searched for (step F3). If there is no channel, the processing has already been terminated, and the processing ends (step F4). If there is a channel of PTG=1, the number of that channel i is obtained (step F5), and the flag PTG of the i-th channel is set to "0" (step F6).

Then, a key-off signal is sent to the i-th tone generating channel of the tone generator 30 (step F7), to terminate the generation of the portamento sound and to terminate the processing (step F4).

As has been described above, according to this embodiment, in an electronic musical instrument having a plurality of tone generating channels, each tone generating channel can selectively achieve the tone generation ascribed to the keyboard, and the tone generation ascribed to the portamento bar.

Further, when designated pitch of the portamento bar and the designated pitch of the keyboard are close to each other, shift between the two can be achieved in the same tone generating channel.

Namely, when the newly depressed position in the portamento bar is near the position of a depressed key in the keyboard, the tone generation of the depressed key sound will shift into the tone generation of the portamento sound. On the contrary, when the depressed position in the portamento bar is near the position of a newly depressed key in the keyboard, the tone generation of the portamento sound will shift into the tone generation of a depressed key in the keyboard.

In the above-described embodiments, since each of the plurality of tone generating channels of the tone generator is capable of generating either a scale sound (keyboard sound) or a portamento sound, the utilization rate of the tone generating channels as a whole is improved.

Since manipulation information of the keyboard and the portamento bar are extracted and commonly assigned to the tone generating channels, organic combination of the portamento bar and the keyboard can be enhanced and a variety of portamento plays is made possible.

When a portamento play is initiated by depressing a key in the keyboard, the portamento sound can be initiated at an accurate pitch sound. Also when a portamento play is terminated by depressing a key in the keyboard, the portamento sound can be terminated at an accurate pitch sound. Although description has been made referring to a limited number of embodiments of the invention hereinabove, this invention should not be limited thereto. It will be apparent for those skilled in the art that, for example, various changes, modifications, improvements, and combinations are possible within the scope of the appended claims.

For example, when the tone generation of the portamento sound shifts to the tone generation of a keyboard sound, and when the pitch of the portamento bar sound under generation is departed from the pitch of the newly depressed key, the pitch may be shifted gradually by inserting intermediate pitches to generate a continuously changing sound. Also, when the tone generation of the depressed key shifts to the tone generation of a portamento sound, and if there is a pitch gap if the tone pitch designated by the portamento bar is immediately generated, intermediate pitches may be inserted to change the pitch gradually, to generate a continuously changing pitch sound.

We claim:

1. An electronic musical instrument comprising:

a keyboard having a plurality of keys capable of designating respective predetermined scale pitches;

a portamento bar capable of designating a substantially arbitrary pitch;

first detection means for detecting manipulation information of said keyboard;

second detection means for detecting manipulation information of said portamento bar;

a first table storing correspondence relations between said keys of the keyboard and sales assigned thereto;

a second table storing correspondence relations between a position in said portamento bar and a pitch of a tone to be generated, said second table including (i) a half tone table for transforming a position in said portamento bar between a pair of adjacent half tone keys in said keyboard into intermediate pitch information which is between the scale pitches designated by the pair of adjacent half tone keys, and (ii) a whole tone table for transforming a position in said portamento bar between a pair of adjacent whole tone keys in said keyboard into intermediate pitch information which is between the scale pitches designated by the pair of adjacent whole tone keys;

a tone generator having a plurality of tone generating channels, each being commonly coupled to the manipulation information of said keyboard and said portamento bar; and tone generation assignment means for assigning generation of musical sound to said tone generating channels based on the manipulation information of said keyboard and said portamento bar.

2. An electronic musical instrument according to claim 1, wherein said portamento bar is disposed spatially parallel to said keyboard.

3. An electronic musical instrument according to claim 1, wherein said portamento bar includes a resistance element and a conductive element which can be deformed to touch the resistance element by manipulation of a player, and said second detection mean includes a voltage detector connected to said conductive element.

4. An electronic musical instrument according to claim 1, wherein said tone generation assignment means includes means for comparing, when a new key depression is made in said keyboard while a portamento sound has been generated, pitches of the portamento sound and of the newly depressed key, taking a difference of said pitches, and re-assigning that channel which has been generating the portamento sound for generating a sound for the newly depressed key when said difference is within a predetermined range.

5. An electronic musical instrument according to claim 1, wherein said tone generation assignment means includes means for comparing, when a new manipulation is made in said portamento bar while a keyboard sound has been generated, pitches of the keyboard sound and of the new manipulation in the portamento bar, taking a difference of said pitches, and re-assigning that channel which has been generating the keyboard sound for generating a sound for the new manipulation in the portamento bar when said difference is within a predetermined range.

6. An electronic musical instrument comprising:

a keyboard having a plurality of keys capable of designating respective predetermined scale pitches;

a portamento bar capable of designating a substantially arbitrary pitch;

first detection means for detecting manipulation information of said keyboard;

second detection means for detecting manipulation information of said portamento bar;

a first table storing correspondence relations between said keys of the keyboard and scales assigned thereto;

a second table storing correspondence relations between a position in said portamento bar and a pitch of a tone to be generated;

a tone generator having a plurality of tone generating channels, each being commonly coupled to the manipulation information of said keyboard and said portamento bar; and tone generation assignment means for assigning generation of musical sound to said tone generating channels based on the manipulation information of said keyboard and said portamento bar.

7. An electronic musical instrument according to claim 6, wherein said portamento bar is disposed spatially parallel to said keyboard.

8. An electronic musical instrument according to claim 6, wherein said portamento bar includes a resistance element and a conductive element which can be deformed to touch the resistance element by manipulation of a player, and said second detection mean includes a voltage detector connected to said conductive element.

9. An electronic musical instrument according to claim 6, wherein said tone generation assignment means includes means for comparing, when a new key depression is made in said keyboard while a portamento sound has been generated, pitches of the portamento sound and of the newly depressed key, taking a difference of said pitches, and re-assigning that channel which has been generating the portamento sound for generating a sound for the newly depressed key when said difference is within a predetermined range.

10. An electronic musical instrument according to claim 6, wherein said tone generation assignment means includes means for comparing, when a new manipulation is made in said portamento bar while a keyboard sound has been generated, pitches of the keyboard sound and of the new manipulation in the portamento bar, taking a difference of said pitches, and re-assigning that channel which has been generating the keyboard sound for generating a sound for the new manipulation in the portamento bar when said difference is within a predetermined range.

* * * * *